US009701155B2

(12) United States Patent
Henderson

(10) Patent No.: US 9,701,155 B2
(45) Date of Patent: Jul. 11, 2017

(54) CHALK LINE

(71) Applicant: Steve Henderson, Sebastian, FL (US)

(72) Inventor: Steve Henderson, Sebastian, FL (US)

( * ) Notice: Subject to any disclaimer, the term of this patent is extended or adjusted under 35 U.S.C. 154(b) by 70 days.

(21) Appl. No.: 14/751,751

(22) Filed: Jun. 26, 2015

(65) Prior Publication Data

US 2016/0375720 A1 Dec. 29, 2016

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/414
See application file for complete search history.

(56) References Cited

U.S. PATENT DOCUMENTS 4,924,597 A * 5/1990 Tursi ..... G01B 3/1071 33/758
5,873,174 A * 2/1999 Kraft ..... G01B 3/1071 33/758
6,082,014 A * 7/2000 Beyers ..... B44D 3/38 33/413
6,360,445 B1 * 3/2002 Haas ..... B44D 3/38 33/1 LE
7,676,941 B2 * 3/2010 Cruz ..... B44D 3/38 33/414
7,716,848 B1 * 5/2010 Calvey ..... G01B 3/1056 33/758
8,819,950 B1 * 9/2014 Lemcke ..... B44D 3/38 33/413
2009/0277027 A1 * 11/2009 Grisham ..... B44D 3/38 33/414
2016/0023507 A1 * 1/2016 Douglas ..... B44D 3/38 33/414
2016/0375720 A1 * 12/2016 Henderson ..... B44D 3/38 33/414

* cited by examiner

*Primary Examiner* — Yaritza Guadalupe-McCall
(74) *Attorney, Agent, or Firm* — Stephen C. Thomas

(57) ABSTRACT

An improved chalk line and chalk line hook that eliminates the marking errors of prior art chalk line hooks is claimed and described. The improved chalk line hook comprises a gripping hook, line attachment loop rotatably attached to a surface of the gripping hook, and rotating attachment means which may be a pivot pin. The axis of rotation of the line attachment loop is disposed directly over the securing edge of the gripping hook, eliminating the offset suffered by prior art chalk line hooks. The invention may further comprise a container able to contain powdered chalk and having an aperture for the line to pass through, a rotating reel for dispensing and retrieving chalk line, and line passing through the container aperture and attached to a chalk line hook of the invention. The invention may further comprise a magnet disposed on a surface of the gripping hook.

22 Claims, 4 Drawing Sheets

CHALK LINE

This is document is a non-provisional application for patent filed in the United States Patent and Trademark Office (USPTO) under 35 U.S.C. §111(a).

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to tools utilized in the construction and building trades. More specifically, the field of the invention relates to tools used to demarcate straight lines for purposes such as, for example and not by way of limitation, cutting, forming, or other construction tasks in which long lines must be temporarily marked in order to aid the construction worker in making straight lines, cuts, or other construction or building operations.

2. Background Art

Various tools and techniques for marking straight lines as may be desired by, for instance, the construction of building trades, are generally known in the art. One such tool comprises a reel of line or some similar material such as cord, disposed within a container filled with a marketing substance such as for example powdered chalk. The powdered chalk is generally of a color useful for marking such as, red blue green black or some other color that is selected to contrast the material to be marked. The material to be marked may be any construction material such as, for example, plywood, cement, concrete, brick, shingles, or any other construction material that may be encountered on a building site. Generally, the line is extracted from the real, placed in a desired position on the material to be marked, stretched taut, and snapped by gently lifting and releasing the line. When the line is snapped it leaves a linear mark by displacing some of the chalk contained on the line onto the surface to be marked. In this manner a straight line may be created which may be utilized by a user two, for example, perform a cut such as when trimming plywood or some other material during a construction operation.

The device which comprises a container, a reel containing line, and powdered chalk is known in the art as a chalk line. The line generally has a free end that may be pulled in order to extract the line from the reel. The line generally has a captured end which is attached to, for example, an axle of the reel. The free end of the line may be pulled by a worker or other person to extract the chalked line from the real so that it may be placed on a surface to be marked and snapped, leaving a desired mark. Once the marking operation is complete, the reel may be operated to retrieve the line back into the container where it may be re-coated with the powdered chalk disposed within the container. The container typically has an aperture in at least one surface so that the chalk line may be extracted from the reel, through the aperture, when the free end of the line is pulled. The aperture is generally large enough to allow the line to be extracted through the aperture by pulling on the free end of the chalk line and rotating the reel such that the line is extracted, but the aperture is generally small enough to prevent a significant amount of chalk from escaping from the container. There may be other baffles or interior features that also assist in preventing the powdered chalk from escaping the container. Generally, chalk lines are small enough to be held in the hand of a worker.

In order to assist the placement of a chalk line onto a surface to be marked and to stretch it tautly enough so that it may be snapped as described above, the free end of the chalk line may terminate in a chalk line hook. The chalk line hook typically comprises a simple bent piece of stiff material, such as metal, which is attached to the chalk line free end, and that may be placed over an edge or other retaining feature of a surface to be marked so that the chalk line may be stretched taut and disposed on the surface to be marked so that it may be snapped in order to leave a straight line to guide the construction worker in a construction operation.

One problem that is often encountered in the use of a chalk line of the prior art to place a mark on a surface to be marked arises when the desired mark is not perpendicular to the edge or other feature of the surface to be marked. In such situations, the hooks of the prior art tend to cause an offset A as shown in FIG. 1*a*. This offset may be caused by the displacement A that results from the configuration of the hooks of the prior art is shown in FIG. 1*b*. The resulting displacement A results in a marked line that is not in the desired position as indicated by dashed line C. The undesired result of the use of the chalk line hooks of the prior art is that the marked line is not exactly in the desired position and may lead to construction defects or other undesired effects. When a marked line is not placed in the desired position several negative consequences may result. First, the line may need to be rubbed out and remarked. However, when the light is remarked using the same chalk line of the prior art, the same error in marketing may occur and thus this process may need to be repeated several times. Secondly, in the instance in which the line is marking a cut to be made such as, for example, on plywood, the worker may proceed to cut along the errantly marked surface, resulting in construction errors. This may require replacement of the surface to be cut with resulting expense and loss of time. If the surface is not replaced, the construction project may be completed with errors, sometimes significant errors which may be visible and may result in an unsightly finished work product.

Typically, chalk lines are tools comprising a construction worker's toolset.

What is needed in the art, therefore, is an economic improved chalk line hook that eliminates the undesired effects of the displacement A as depicted in FIG. 1*b*. Such an improved chalk line hook would enable more accurate construction, fewer construction defects, reduce costs due to reduced occurrences of rework, reduced time for construction due to less rework, and other beneficial effects.

BRIEF SUMMARY OF THE INVENTION

The present invention comprises an apparatus and method that have one or more of the following features and/or steps, which alone or in any combination may comprise patentable subject matter.

The present invention overcomes the shortcomings of the prior art in that it provides an economic chalk line hook, and in an embodiment a chalk line and chalk line hook, that allows a chalk line to swivel at a point that is directly on, or very near, the edge or other retaining feature of the surface to be marked. In this manner, the displacement A depicted in FIG. 1*b*, which is the cause of significant marking errors in the chalk lines of the prior art, is significantly reduced or eliminated. This allows more accurate marking and results in fewer construction defects, less lost time due to rework and remarking, improvement and construction schedules and reduction in construction cost. The improved chalk line hook of the invention is economic to manufacture and is therefore desirable as an inexpensive feature providing the above benefits. The chalk line hook of the invention may be used in any application wherein it is desired to place a line in desired position terminating at an edge of a supporting surface, and thus the invention may be used in many applications other than chalk lines.

In accordance with one embodiment of the present invention, the invention comprises a gripping hook, a line attachment loop, and a pivot pin that rotatably engages the line attachment loop to the gripping hook so that a line, such as a chalk line, may be attached to the line attachment loop and, when the gripping hook is secured against the retaining surface, such as the edge or other retaining feature of a surface to be marked, the line may be pulled taut and moved in an arc that has its center at the location of the pivot pin. The pivot pin acts to rotatably attach the line of attachment loop to a surface of the gripping, and is disposed so that the pivot pin is located at or very near an edge or other retaining feature of a surface to be marked. The result is that a chalk line attached to the line attachment loop may be pulled taut and rotated about the pivot pin while the gripping hook is removably attached to an edge or other retaining feature of a surface to be marked area thus the chalk line may be rotated at a point that is very near the edge or other retaining feature of the surface to be marked. The closeness of the pivot pin to the edge or other attending feature of the surface to be marked significantly reduces or eliminates the error in the marked line caused by the displacement A of FIG. 1*b* which is caused when chalk line hooks of the prior art are used to mark lines in surfaces in which the desired position of the marked line is not perpendicular to an edge of the surface to be marked, and thus the use of the improved chalk line hook of the present invention results in the above mentioned benefits. The improved chalk line hook of the present invention may be fabricated from any material that is of sufficient stiffness to substantially retain its shape when a chalk line attached to the line of attachment loop is pulled so that the chalk line is taut enough to be snapped as hereinbefore described, leaving a marked line on a surface to be marked. Such materials may include but are not limited to metals, plastics, or any other materials of sufficient stiffness as hereinbefore described.

In accordance with a further embodiment of the invention, the improved chalk line of the invention comprises a chalk line container, a reel rotatably attached to the chalk one container and capable of containing powdered chalk, wherein the container comprises an aperture through which line may be dispensed from more retrieved onto the reel, and wherein the chalk line comprises a captured end and a free end where in the captured end is attached to a spindle of the real, the line passes through the aperture of container, and the free end of the line attaches to the improved chalk line hook of the invention is depicted and described herein. Any of the embodiments of the invention may, but do not necessarily, further comprise a magnet for removably attaching to a surface, such as a ferrous surface.

BRIEF DESCRIPTION OF THE DRAWINGS

The accompanying drawings, which are incorporated into and form a part of the specification, illustrate the deficiencies of the prior art, and further illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

The following documentation provides a detailed description of the invention.

Figure 1B:
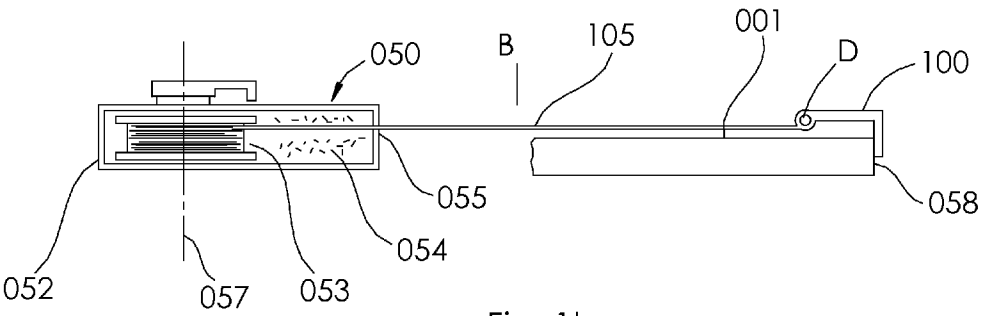
FIG. 1*b* depicts a side view of a chalk line of the present invention in use and showing the chalk line container broken away so that the chalk line reel, line and powdered chalk or depicted; also depicted is the axis of rotation of a chalk line reel.
Figure 1A:
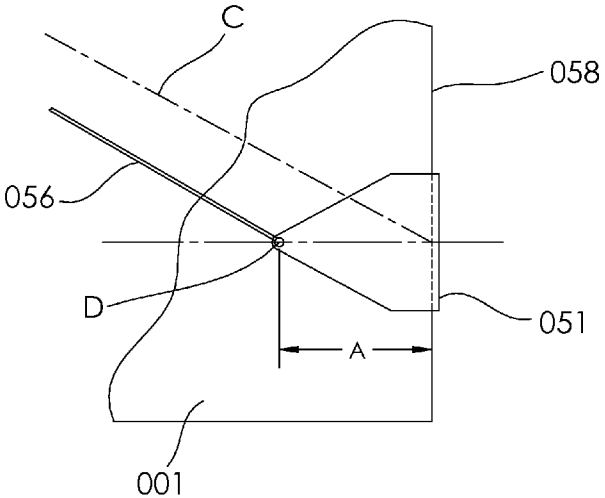
FIG. 1*a* depicts a top view of a chalk line of the prior art in use, and illustrating the error caused by the deficiencies of the chalk line hooks of the prior art, demonstrating a need for the present invention.
Figure 1C:
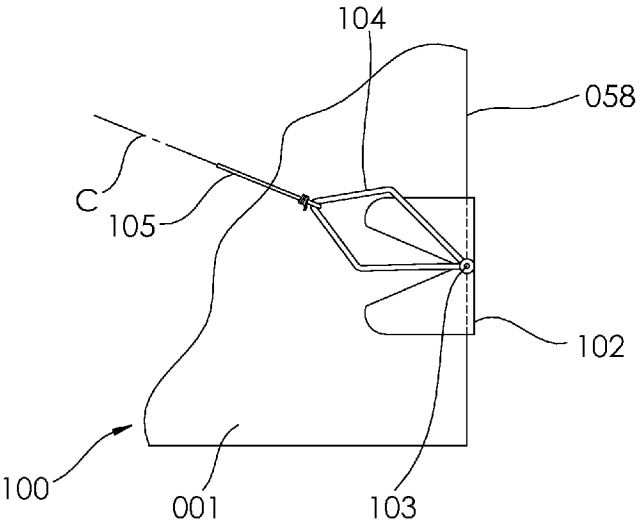
FIG. 1*c* depicts a top view of a chalk line and chalk line hook of the present invention illustrating that use of the chalk line and chalk hook of the present invention eliminates the displacement of the chalk lines of the prior art and therefore eliminates the errors caused by this displacement.

Referring now to FIGS. 1*b* and 1*c*, a chalk line 050 and chalk line hook 102 of the present invention are depicted. In general, a container 052 may contain powdered chalk 054 and reel 053 which may have line 056 spooled upon it. Real 053 may be rotatably attached to container 052 so that it is free to rotate about an axis 057. Line 105 may become coated with powdered chalk 054 due to chalk 054 and line 105 both being disposed within container 052. When it is desired to mark a surface 001, chalk line hook 102 may be grasped and pulled away from container 052 to be disposed on an edge 058 of the structure comprising surface to be marked 001. Line 105 may then be pulled taut and snapped by grasping and displacing line 105 in the direction of arrow B and releasing it, such that it snaps back into its taut position as depicted in the figures, impacting the surface to be marked 001 and displacing some of the chalk from line 056 onto the surface to be marked 051 leaving a straight line which may be then used by the user for any operation desired, such as, for example, cutting. In this manner for example the user may use a chalk line to mark plywood or some other construction material for cutting.

Referring now to FIG. 1*a*, a top view of chalk line hook of the prior art 051 is depicted as it would appear in use. In the example shown in FIG. 1*a*, it is desired to mark a line C. However, due to displacement A which is the distance from the retaining feature of the surface to be marked to the line attachment point D where the chalk line is attached to the chalk line hook of the prior art, the actual line marked on the surface to be marked follows line 056. The resulting offset between line 056 in the desired location of the line to be marked C represents an undesirable error, with the resulting negative effects as hereinbefore described.

Referring now to FIG. 1*c*, some of the advantages of the improved chalk line and chalk line hook of the present invention 100 are depicted. Gripping hook 102 may be disposed so as to be in contact with an edge 058 of surface to be marked 001 so that line 105 may be pulled taut as depicted in the figure. Line 105 may be attached to line attachment loop 104. Line attachment loop 104 may also be rotatably engaged with a surface of gripping hook 102 by a rotating attachment having an axis of rotation. The rotating attachment may be provided by pivot pin 103. In the resulting rotating attachment between line attachment loop 104 and gripping hook 102, pivot pin 103 forms an axis about which line 105 and line attachment loop 104 may rotate. It can be seen by observing FIG. 1C that pivot pin 103 is disposed in a surface of gripping hook 102 such that the axis of rotation is located over edge 058 of surface to be marked 001. Thus, the axis of rotation of line 105 and one attachment loop 104 is located directly over edge 058 surface to be marked 001, eliminating displacement A shown in FIG. 1*b* and thereby eliminating the error caused by displacement A. By using the improved chalk line hook of the invention 100, a user is therefore able to accurately mark the desired line C by snapping line 105 such that it leaves a chalk trace on surface to be marked 001 that is accurately marked along the desired line C. The improved chalk line hook of the invention improves a state-of-the-art by eliminating the error caused by displacement A in the chalk line hooks of the prior art.

Figure 2:
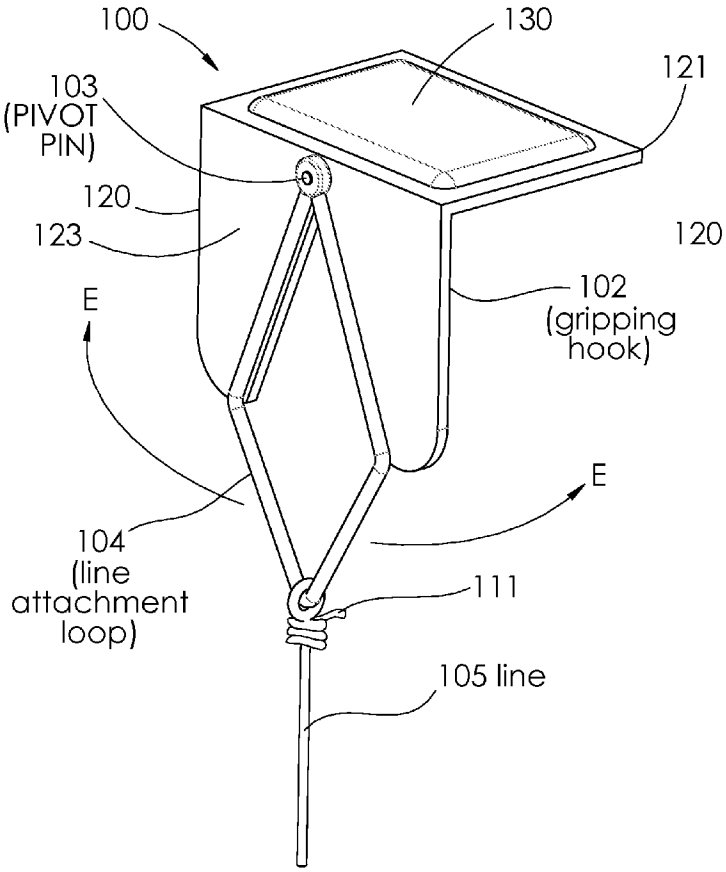
FIG. 2 depicts a perspective view of an embodiment of the improved chalk line hook of the invention, showing the rotatable attachment between the line attachment loop and gripping hook of the invention in which the line attachment loop is rotatably attached to the gripping hook by a pivot pin of the invention. Also depicted in FIG. 2 is a magnet attached to a surface of the chalk line hook of the invention for removably attaching the chalk line hook to a surface, such as a ferrous surface.

Referring now to FIG. 2 a perspective view of an embodiment of the improved chalk line hook of the invention 100, showing the rotatable attachment between the line attachment loop 104 and gripping hook 102 of the invention in which the line attachment loop 104 is rotatably attached to the gripping hook 102 by a pivot pin 103 of the invention is depicted. In the view depicted in FIG. 2, chalk line 105 has been pulled taught in a direction that is approximately perpendicular to an edge of the surface to be marked (not shown in FIG. 2). Line 105 may be attached to line attachment loop 104 at line attachment point 111 by any means known in the art for attaching a line to a structure which may include, but is not limited to, tying as depicted in FIG. 2. Likewise snap swivels or other means for attaching line 105 to line attachment loop structure 104 may be utilized. Line attachment loop 104 may be rotatably attached to a surface of gripping hook 102 for example by pivot pin 103. Thus, line attachment loop may be free to rotate about an axis formed by pivot pin 103 on an axis of rotation. Pivot pin 103 may be secured to a surface of gripping hook 102 by any means known in the art such as, for example and not by way of limitation, swaging fitting or by use of matching male and female threads, in which pin 103 may comprise male threads which match female threads disposed in a surface of gripping hook 102. Pin 103 is attached to a surface of gripping 102 so as to allow a rotating engagement between line attachment loop 104 and gripping hook 102 in the directions of arrows E as shown in the figure. Thus, a line such as a chalk line 105 may be attached to line attachment loop 104 and, when line 105 is pulled taut and moved in the direction of arrows E, line attachment loop and line 105 may rotate around an axis formed by pivot and 103. Line attachment loop 104 may take any shape that allows rotatable engagement with pivot pin 103 and also allows for attachment of line 105 by any means known in the art. Thus, in the figures of the drawings, line attachment loop 104 is depicted as a four sided shape that may be comprised of wire, but the scope of the invention is not to be limited to the shape depicted in the figures, as line attachment loop 104 may be any shape convenient for fabrication or for any other purpose, as long as line attachment loop may be rotatably engaged with pivot pin 103 and also may be attached to line 105. The invention may, but does not necessarily, further comprise an optional magnet 130 disposed on a surface of gripping hook 102 which may be useful for magnetically attaching the chalk line hook of the invention to metals, such as ferrous metals, and any other materials attracted to magnets.

Figure 3:
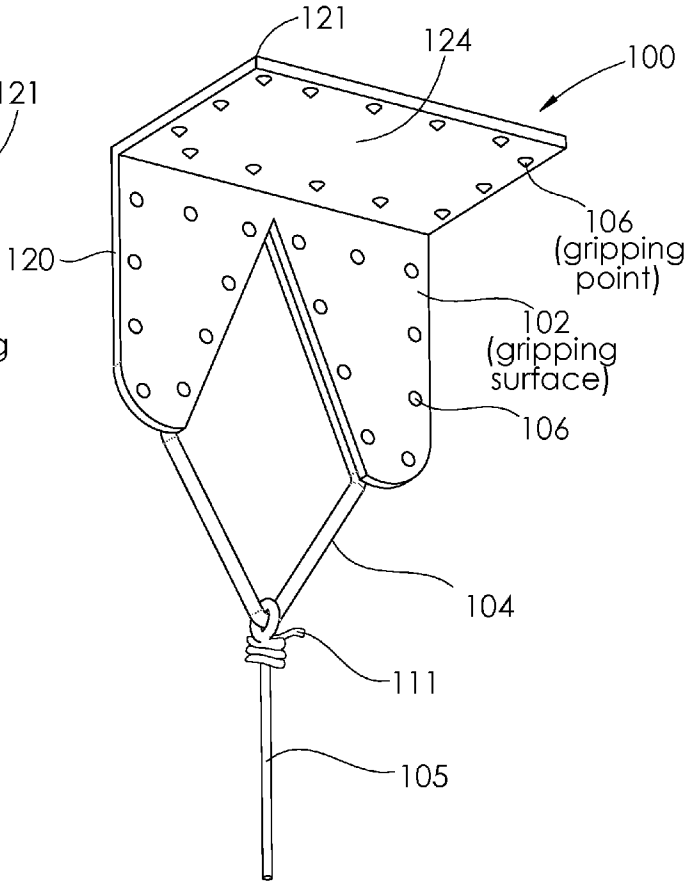
FIG. 3 depicts a perspective bottom view of an embodiment of the invention, illustrating a plurality of gripping points disposed on gripping surfaces of the invention and also illustrating a line attached to the line attachment loop of the invention, which may be rotatably attached to the gripping hook.

Referring now to FIG. 3, a perspective bottom view of an embodiment of the invention, illustrating a plurality of gripping points 106 disposed on gripping surfaces of the invention and also illustrating a line 105 attached to the line attachment loop 104 of the invention, which may be rotatably attached to gripping hook 102 is depicted. Gripping points 106 may be formed by any means known in the art for forming small features such as cones, bumps, other raised features, stampings with protruding sharp points, or any other features that may be utilized to grip surface. One or more gripping points 106 may be utilized to aid the grip of gripping hook 102 onto a surface or feature comprising an element of the surface to be marked. In this manner, gripping hook 102 may be securely placed onto a surface or feature comprising an element of the surface to be marked so that line 105 may be pulled taut and snapped, disposing some of its chalk onto the surface to be marked and thereby marking a line as may be desired by a user.

Figure 4:
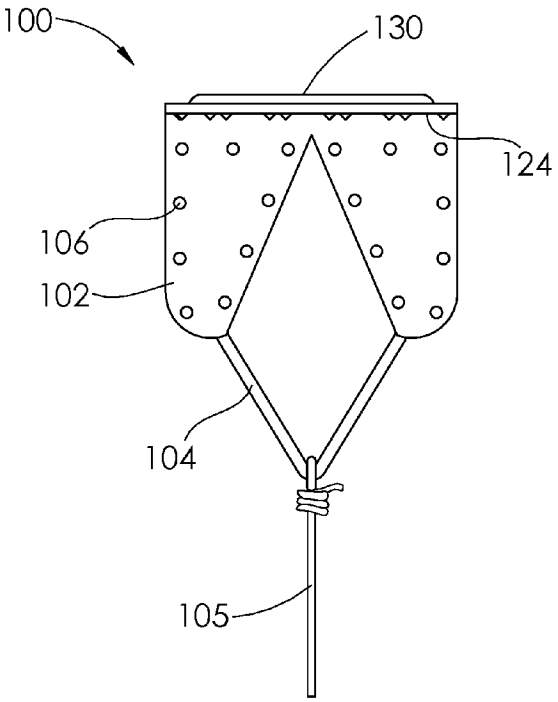
FIG. 4 depicts a front view of an embodiment of the improved chalk line hook of the invention. Also depicted in FIG. 4 is a magnet attached to a surface of the chalk line hook of the invention for removably attaching the chalk line hook to a surface, such as a ferrous surface.

Referring now to FIG. 4, a front view of an embodiment of the improved chalk line hook of the invention is depicted. Optional gripping points 106 may be disposed on one or more surfaces of gripping hook 102. The improved chalk line hook of the invention 100 may comprise any number of gripping points 106. The number of gripping points depicted in the figures of the drawings is representative only of an exemplary embodiment of the invention. The specific number of gripping points is not to be construed as a limitation on the scope of the invention. Line attachment loop 104 is rotatably attached to a surface of gripping hook 102 by pivot pin 103 (not shown in FIG. 4 but shown in FIGS. 2, 5, 6, 8, and 9). The invention may further comprise an optional magnet 130 disposed on a surface of gripping hook 102 which may be useful for magnetically attaching the chalk line hook of the invention to metals, such as ferrous metals, and any other materials attracted to magnets.

Figure 6:
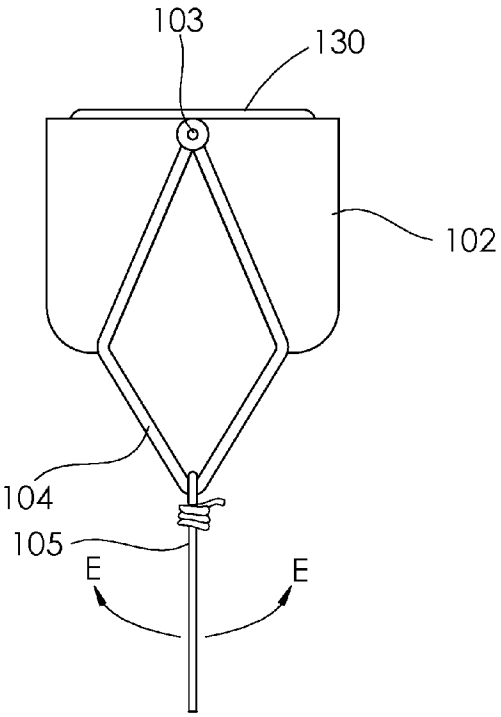
FIG. 6 depicts a rear view of an embodiment of the improved chalk line hook of the invention, illustrating the rotatable attachment between the line attachment loop of the invention and the gripping hook of the invention, wherein the line attachment loop and gripping hook are rotatably attached by a pivot pin. Also depicted in FIG. 6 is a magnet attached to a surface of the chalk line hook of the invention for removably attaching the chalk line hook to a surface, such as a ferrous surface.
Figure 5:
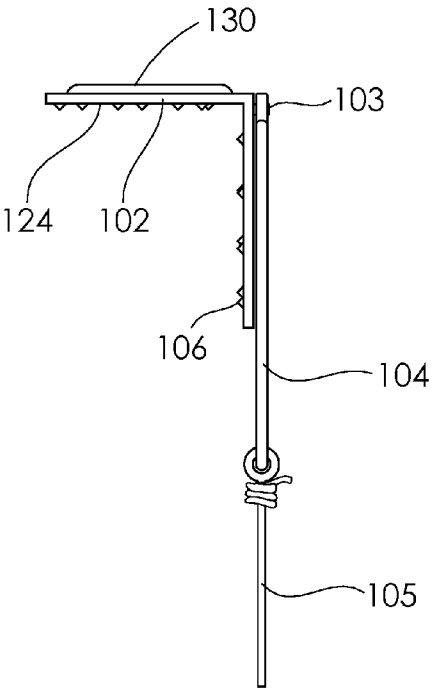
FIG. 5 depicts a side view of an embodiment of the improved chalk line hook of the invention. Also depicted in FIG. 5 is a magnet attached to a surface of the chalk line hook of the invention for removably attaching the chalk line hook to a surface, such as a ferrous surface.

Referring now to FIGS. 5 and 6, a side and rear view, respectively, of an embodiment of the improved chalk line hook of the invention 100 are depicted. The improved chalk line hook of the invention 100 may comprise any number of gripping points 106; line attachment loop 104 may be attached to line 105 by any means known in the art as hereinbefore described, and may be further rotatably attached to a surface of gripping hook 102 also as hereinbefore described. The invention may further comprise a magnet 130 disposed on a surface of gripping hook 102 which may be useful for magnetically attaching the chalk line hook of the invention to metals, such as ferrous metals, and any other materials attracted to magnets.

Figure 9:
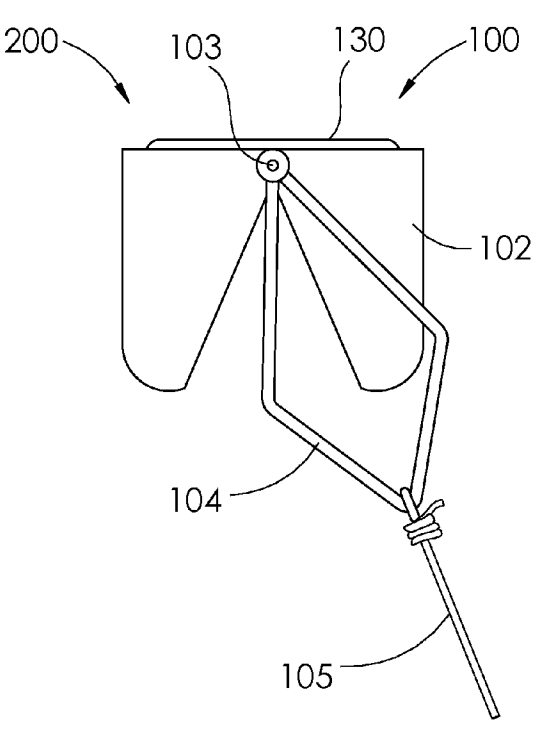
FIG. 9 depicts a rear view of an embodiment of the invention in which the improved chalk line hook of the invention is placed over and is rotatably engaged with a nail wherein the nail forms the retaining feature of the surface to be marked. Also depicted in FIG. 9 is a magnet attached to a surface of the chalk line hook of the invention for removably attaching the chalk line hook to a surface, such as a ferrous surface.
Figure 8:
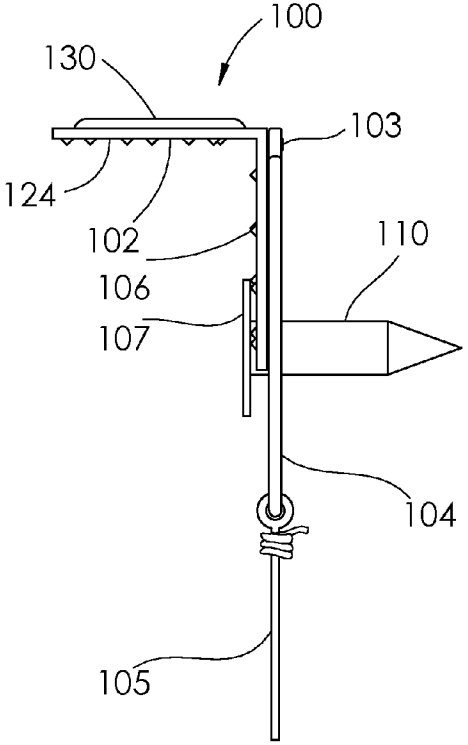
FIG. 8 depicts a side view of an embodiment of the invention in which the improved chalk line hook of the invention is placed over and is rotatably engaged with a nail wherein the nail forms the retaining feature of the surface to be marked. Also depicted in FIG. 8 is a magnet attached to a surface of the chalk line hook of the invention for removably attaching the chalk line hook to a surface, such as a ferrous surface.
Figure 7:
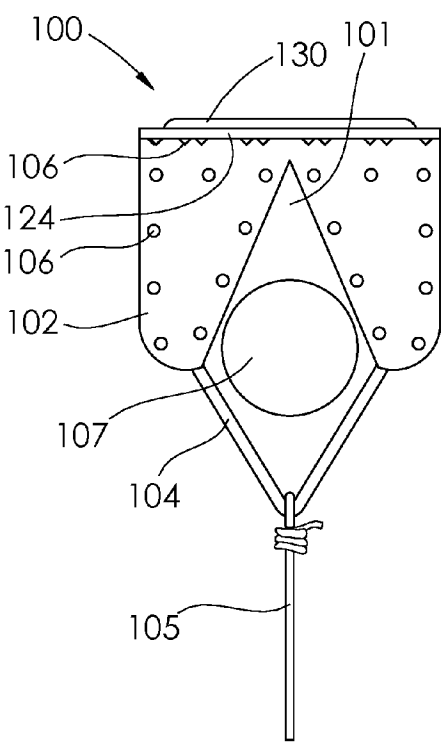
FIG. 7 depicts a front view of an embodiment of the invention in which the improved chalk line hook of the invention is placed over and is rotatably engaged with a nail wherein the nail forms the retaining feature of the surface to be marked. Also depicted in FIG. 7 is a magnet attached to a surface of the chalk line hook of the invention for removably attaching the chalk line hook to a surface, such as a ferrous surface.

Referring now to FIGS. 7, 8 and 9 a front view, side view, and view, respectively, of an embodiment of the improved chalk line hook of the invention 100 is depicted, wherein the improved chalk line hook of the invention 100 has been placed over a nail 107 disposed in the surface to be marked in order to be retained in place over the nail as chalk line 105 is pulled taut, causing the cylindrical shaft 110 (not depicted in FIG. 7 but depicted in FIG. 8) of nail 107 to come into contact with V groove 101 disposed in a surface of gripping hook 102. Thus FIGS. 7, 8 and 9 depict one of many intended uses of the improved chalk line hook of the invention 100. In the intended use depicted in FIGS. 7, 8 and 9 the improved chalk line hook of the invention is secured against nail 107, and nail 107, in this exemplary use, forms a retaining feature of the surface to be marked. Thus, when chalk line 105 is pulled taut, cylindrical shaft 110 of nail 107 comes into contact with the groove 101 of the improved chalk line hook 100 of the invention, and the user may proceed to displace and release chalk line 105, causing it to step back into its taught position in releasing chalk to mark a line on the surface to be marked as desired by the user. In this manner, the improved chalk one hook of the invention is not retained on an edge of the surface to be marked but is rather retained by a nail 107 disposed in the surface to be marked. The invention may further comprise a magnet 130 disposed on a surface of gripping hook 102 which may be useful for magnetically attaching the chalk line hook of the invention to metals, such as ferrous metals, and any other materials attracted to magnets.

Referring now to FIGS. 2-9, griping hook 102 may comprise a first planar leg 120 and a second planar 121 leg having an common edge 122 forming an angle there between, each leg having an interior and exterior surface, and wherein the rotatable attachment between line attachment loop 104 and gripping hook 102 is disposed in said exterior surface of said first planar leg 123, and wherein said surface for securing against an edge of a surface to be marked is defined as the interior surface 124 of said second planar leg 121. In an embodiment, the angle between the first planar leg 120 and second planar 121 leg may be, but is not necessarily, ninety degrees.

Although a detailed description as provided herein and in the drawings contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

What is claimed is:

1. A chalk line hook, comprising:

a gripping hook and a line attachment loop;

wherein said gripping hook comprises a surface for securing against an edge of a surface to be marked; and wherein said line attachment loop is rotatably attached to a surface of said gripping hook by a rotatable attachment, said rotatable attachment having an axis of rotation, and said line attachment loop is also adapted to attach to a line; and wherein said axis of rotation is disposed directly over an edge of said surface to be marked when said surface for securing of said gripping hook is secured against an edge of a surface to be marked.

2. The chalk line hook of claim 1, wherein said rotatable attachment between said line attachment loop and said surface of said gripping hook further comprises a pivot pin attached to said surface of said gripping hook and rotatably attached to said line attachment loop.

3. The chalk line of claim 2 in which said surface for securing against an edge of a surface to be marked further comprises at least one gripping point.

4. The chalk line of claim 1, wherein said griping hook comprises a first planar leg and a second planar leg having an common edge forming an angle therebetween, each leg having an interior and exterior surface, and wherein said rotatable attachment between said line attachment loop and said gripping hook is disposed in said exterior surface of said first planar leg, and wherein said surface for securing against an edge of a surface to be marked is defined as the interior surface of said second planar leg.

5. The chalk line of claim 4 in which said surface for securing against an edge of a surface to be marked further comprises at least one gripping point.

6. The chalk line of claim 1, wherein said griping hook comprises a first planar leg and a second planar leg having an common edge forming an angle therebetween, each leg having an interior and exterior surface, and wherein said rotatable attachment between said line attachment loop and said gripping hook is disposed in said exterior surface of said first planar leg, and wherein said surface for securing against an edge of a surface to be marked is defined as the interior surface of said second planar leg.

7. The chalk line of claim 6 in which said angle is ninety degrees.

8. The chalk line of claim 7 in which said surface for securing against an edge of a surface to be marked further comprises at least one gripping point.

9. The chalk line of claim 6 in which said surface for securing against an edge of a surface to be marked further comprises at least one gripping point.

10. The chalk line of claim 1 in which said surface for securing against an edge of a surface to be marked further comprises at least one gripping point.

11. The chalk line hook of claim 1, further comprising a magnet disposed on a surface of said gripping hook.

12. A chalk line, comprising:

A chalk container capable of containing powdered chalk, having a reel disposed therein rotatably attached to an interior surface of said container and comprising line for snapping chalk line marks, wherein said reel comprises line having a first end and a second end, said first end attached to said reel and said end passing through an aperture in said container;

a chalk line hook;

wherein said line is attached to a line attachment loop that is attached to a surface of said chalk line hook by a rotatable attachment having an axis of rotation;

wherein said gripping hook comprises a surface for securing against an edge of a surface to be marked; and and wherein said axis of rotation is disposed directly over an edge of said surface to be marked when said surface for securing of said gripping hook is secured against an edge of a surface to be marked.

13. The chalk line hook of claim 12, wherein said rotatable attachment between said line attachment loop and said surface of said gripping hook further comprises a pivot pin attached to said surface of said gripping hook and rotatably attached to said line attachment loop.

14. The chalk line of claim 13 in which said surface for securing against an edge of a surface to be marked further comprises at least one gripping point.

15. The chalk line of claim 12, wherein said griping hook comprises a first planar leg and a second planar leg having an common edge forming an angle therebetween, each leg having an interior and exterior surface, and wherein said rotatable attachment between said line attachment loop and said gripping hook is disposed in said exterior surface of said first planar leg, and wherein said surface for securing against an edge of a surface to be marked is defined as the interior surface of said second planar leg.

16. The chalk line of claim 15 in which said surface for securing against an edge of a surface to be marked further comprises at least one gripping point.

17. The chalk line of claim 12, wherein said griping hook comprises a first planar leg and a second planar leg having an common edge forming an angle therebetween, each leg having an interior and exterior surface, and wherein said rotatable attachment between said line attachment loop and said gripping hook is disposed in said exterior surface of said first planar leg, and wherein said surface for securing against an edge of a surface to be marked is defined as the interior surface of said second planar leg.

18. The chalk line of claim 17 in which said angle is ninety degrees.

19. The chalk line of claim 18 in which said surface for securing against an edge of a surface to be marked further comprises at least one gripping point.

20. The chalk line of claim 17 in which said surface for securing against an edge of a surface to be marked further comprises at least one gripping point.

21. The chalk line of claim 12 in which said surface for securing against an edge of a surface to be marked further comprises at least one gripping point.

22. The chalk line hook of claim 12, further comprising a magnet disposed on a surface of said gripping hook.

* * * * *